US007581586B2

(12) United States Patent
Russell

(10) Patent No.: US 7,581,586 B2
(45) **Date of Patent: *Sep. 1, 2009**

(54) WELLBORE SCREEN

(75) Inventor: Thane Geoffrey Russell, Cochrane (CA)

(73) Assignee: Absolute Completion Technologies Ltd., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/839,467

(22) Filed: Aug. 15, 2007

(65) Prior Publication Data

US 2008/0006402 A1 Jan. 10, 2008

Related U.S. Application Data

(63) Continuation of application No. 10/904,869, filed on Dec. 1, 2004, now Pat. No. 7,258,166.

(60) Provisional application No. 60/481,764, filed on Dec. 10, 2003.

(51) Int. Cl.
*E21B 43/08* (2006.01)

(52) U.S. Cl. ..... 166/229; 166/228; 166/227

(58) Field of Classification Search ..... 166/228, 166/229, 232, 205, 227, 233
See application file for complete search history.

(56) References Cited

U.S. PATENT DOCUMENTS

| | | | |
|---|---|---|---|
| 1,488,753 | A | 1/1924 | Kelly |
| 1,750,871 | A | 3/1930 | Wilson |
| 2,391,609 | A | 12/1945 | Wright |
| 2,401,035 | A | 5/1946 | Akeyson et al. |
| 2,540,123 | A | 2/1951 | Kinley |
| 2,798,768 | A | 9/1957 | Babin |
| 3,177,945 | A | 4/1965 | Fether |
| 3,213,950 | A | 10/1965 | Ghelfi et al. |
| 3,273,641 | A | 9/1966 | Bourne |
| 3,299,831 | A | 1/1967 | Watson et al. |

(Continued)

FOREIGN PATENT DOCUMENTS

| | | |
|---|---|---|
| BG | 31730 | 3/1982 |

(Continued)

OTHER PUBLICATIONS

Introduction to Stars Screens, Absolute Engineering Inc., presented prior to Dec. 10, 2003.

*Primary Examiner*—Jennifer H Gay
*Assistant Examiner*—Brad Harcourt
(74) *Attorney, Agent, or Firm*—Bennett Jones LLP

(57) ABSTRACT

A wellbore screen includes a base pipe including a wall, an inner bore surface and an outer surface, an opening formed through the base pipe wall and a filter cartridge mounted in the opening. In one aspect, the wellbore screen includes an impermeable layer relative to the opening and the impermeable layer may be selected to be substantially impermeable when in a closed position in the opening to passage of fluids through the opening and, the impermeable layer is at least one of (i) selectively openable to permit fluid flow through the opening and (ii) selectively closeable when triggered to close the opening. In another aspect, the opening may include a tapering diameter from one end to the other and the filter cartridge may include an outer diameter formed to reversibly and substantially correspondingly taper relative to the opening to permit a taper lock fit in the opening.

8 Claims, 2 Drawing Sheets

U.S. PATENT DOCUMENTS

| | | | | | |
|---|---|---|---|---|---|
| 3,322,199 | A | | 5/1967 | Van Note, Jr. | |
| 5,310,000 | A | | 5/1994 | Arterbury et al. | |
| 5,526,881 | A | | 6/1996 | Martin et al. | |
| 5,551,513 | A | * | 9/1996 | Surles et al. | 166/278 |
| 5,636,661 | A | * | 6/1997 | Moyes | 137/614.2 |
| 5,816,742 | A | * | 10/1998 | Cordewener | 405/43 |
| 6,012,522 | A | | 1/2000 | Donnelly et al. | |
| 6,561,732 | B1 | | 5/2003 | Bloomfield et al. | |
| 7,258,166 | B2 | * | 8/2007 | Russell | 166/229 |
| 2001/0042620 | A1 | | 11/2001 | Ohanesian | |

FOREIGN PATENT DOCUMENTS

| | | |
|---|---|---|
| DE | 1 301 300 | 8/1969 |
| DE | 10031 663 | 8/2001 |

* cited by examiner

WELLBORE SCREEN

CROSS REFERENCE TO RELATED APPLICATIONS

This is a continuation application of U.S. application Ser. No. 10/904,869, filed Dec. 1, 2004, now U.S. Pat. No. 7,258, 166, issued Aug. 21, 2007. The present application claims priority to U.S. provisional patent application 60/481,764, filed Dec. 10, 2003.

FIELD

The invention relates to wellbore tubulars and, in particular, a wellbore screen.

BACKGROUND

Various wellbore tubulars are known and serve various purposes. A wellbore screen is a tubular including a screen material forming or mounted in the tubular wall. In one form, a wellbore screen is an apparatus that can include a base pipe and a plurality of filter cartridges supported in the base pipe. The wellbore screen can be used in wellbores such as those for water, steam injection and/or petroleum product production.

The filter cartridges are mounted in openings through the base pipe wall. The filter cartridges screen fluids passing through the openings into the base pipe for pumping or flow up hole. Of course, the openings may be formed to also permit flow of fluids outwardly therethrough from the inner diameter of the base pipe.

SUMMARY

In accordance with a broad aspect of the present invention, there is provided a wellbore screen comprising: a base pipe including a wall, an inner bore surface and an outer surface, at least one opening formed through the base pipe wall and including a tapering diameter from one end to the other and a filter cartridge mounted in the opening including an outer diameter formed to reversibly and substantially correspondingly taper relative to the opening to permit a taper lock fit in the opening.

In accordance with another broad aspect of the present invention, there is provided a wellbore screen comprising: a base pipe including a wall, an inner bore surface and an outer surface, at least one opening formed through the base pipe wall, a filter cartridge mounted in the at least one opening and an impermeable layer relative to the at least one opening, the impermeable layer selected to be substantially impermeable when in a closed position in the at least one opening to passage of fluids through the at least one opening and, the impermeable layer is at least one of (i) selectively openable to permit fluid flow through the at least one opening and (ii) selectively closeable when triggered to close the at least one opening.

BRIEF DESCRIPTION OF THE DRAWINGS

Drawings are included for the purpose of illustrating certain aspects of the invention. Such drawings and the description thereof are intended to facilitate understanding and should not be considered limiting of the invention. Drawings are included, in which.

DETAILED DESCRIPTION OF VARIOUS EMBODIMENTS

Figure 1:
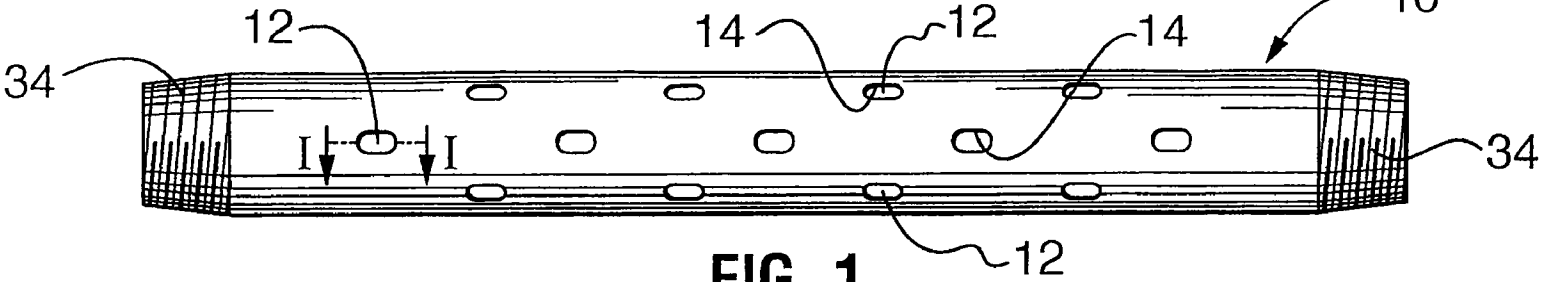
FIG. 1 is a side elevation of a wellbore screen.
Figure 2:
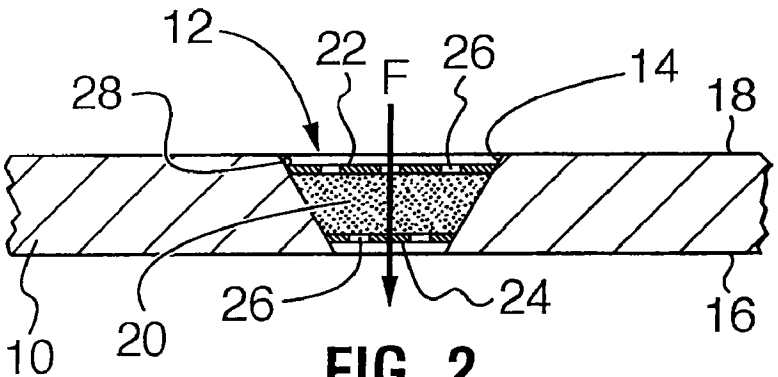
FIG. 2 is a section along line 1-1 of FIG. 1.

Referring to FIGS. 1 and 2, a wellbore screen may include a base pipe 10 and a plurality of filter cartridges 12 supported in the base pipe. Each filter cartridge is mounted in an opening 14 through the base pipe wall from the base pipe inner bore surface 16 to the base pipe outer surface 18. The wellbore screen can be used in various wellbores such as those for water production, steam injection, oil and/or gas production, etc. The filter cartridges of the screen permit fluid flow through openings 14 into or out of the base pipe. Often, the filter cartridges are selected to filter fluids passing through the openings, according to arrow F, into the base pipe for pumping or flow up hole.

A filter cartridge useful in the wellbore screen can comprise a filter media 20. In one embodiment, the filter cartridge can also include one or more retainer plates positioned about the filter media. In one embodiment, as illustrated, the filter cartridge includes an exterior retainer plate 22, an interior retainer plate 24 and filter media 20 contained therebetween. In one embodiment, the exterior retainer plate and the interior retainer plate may be coupled to one another by any of a plurality of methods, such as adhesives, welding, screws, bolts, plastic deformation and so on. In another embodiment, the retainer plates are not secured together but held in position by their mounting in the base pipe.

If used, the exterior retainer plate and the interior retainer plate may contain one or more apertures 26 through which fluid may flow. Exterior retainer plate 22 and interior retainer plate 24 may be constructed of any suitable material, such as plastic, aluminum, steel, ceramic, and so on, with consideration as to the conditions in which they must operate.

Filter media 20 of the filter cartridge can be any media, such as including a layer of compressed fiber, woven media, ceramic and/or sinter disk, that is capable of operating in wellbore conditions. The filter media must be permeable to selected fluids such as one or more of steam, stimulation fluids, oil and/or gas, while able to exclude oversized solid matter, such as sediments, sand or rock particles. Of course, certain solids may be permitted to pass, as they do not present a difficulty to the wellbore operation. Filter media can be selected to exclude particles greater than a selected size, as desired. The present invention can employ one or more layers or types of filter media. In one embodiment, a filter media including an inner woven screen, an outer woven screen and a fibrous material is used. In another embodiment, a filter cartridge may include a single layer of filter media, as shown in FIG. 2, to facilitate manufacture. Sintered material may be useful as a single layer filter media.

Openings 14 may be spaced apart on the base pipe wall such that there are areas of solid wall therebetween. The openings extend through the base pipe sidewall and may each be capable of accommodating a filter cartridge 12. The filter cartridges can be mounted in the openings by various methods including welding, threading, etc. In one embodiment, at least some filter cartridges may be installed by taper lock fit into the openings. In such an embodiment, each of the filter cartridge and the opening into which it is to be installed may be substantially oppositely tapered along their depth so that a taper lock fit can be achieved. For example, the effective diameter of the opening adjacent outer surface 18 may be greater than the effective diameter of the opening adjacent inner bore surface 16 and cartridge 12 inner end effective diameter, as would be measured across plate 24 in the illustrated embodiment, may be less than the effective diameter at the outer end of filter cartridge 12 and greater than the opening effective diameter adjacent inner bore surface 16, so that the filter cartridge may be urged into a taper lock arrangement in the opening. In particular, the outer diameter of the filter cartridge can be tapered to form a frustoconical (as shown), frustopyramidal, etc. shape and this can be fit into the opening, which is reversibly and substantially correspondingly shaped to engage the filter cartridge when it is fit therein. In one embodiment for example, the exterior retainer plate may exceed the diameter of the interior retainer plate of the filter cartridge. Of course, the filter cartridge may be tapered from its inner surface to its outer surface in a configuration that is frustoconical, frustopyramidal, and so on and the openings of the base pipe may be tapered correspondingly so that their diameter adjacent the inner bore surface is greater than that adjacent the side wall outer surface, if desired. However, installation may be facilitated by use of an inwardly directed taper, as this permits the filter cartridges to be installed from the base pipe outer surface and forced inwardly.

The filter cartridges may be secured in the base pipe openings by any of various means. For example, in one embodiment of the present invention, the filter cartridge may be press-fit into the opening of the base pipe. In another embodiment, the filter cartridge may be secured to the opening of the base pipe by an adhesive 28 (for example epoxy), by welding, by soldering, by plastic deformation, and so on, at one or more of the interface points between the filter cartridge and the base pipe. A seal, such as an o-ring, may be provided between the filter cartridge and the opening, if desired.

Figure 3:
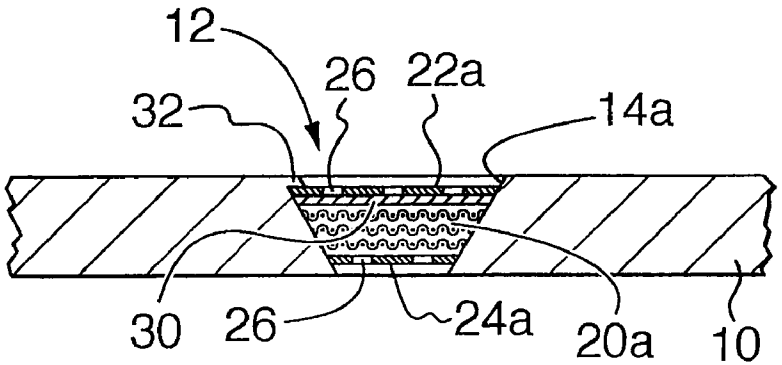
FIG. 3 is a section through another wellbore screen, the sectional position corresponding to that of FIG. 2.

In a further embodiment as shown in FIG. 3, a wellbore screen may include a selectively openable impermeable layer 30 relative to at least some of the plurality of openings, such as illustrated by opening 14*a*. The impermeable layer can be normally closed and when closed is impermeable to solid matter as well as substantially impermeable to fluid flow, such as any or all of wellbore fluids, drilling fluids, injection fluids, etc. Impermeable layer 30, however, can be selectively opened, as by removal, bursting, etc. of the impermeable layer at a selected time, such as when the screen is in a selected position downhole, such as when it is in a finally installed position.

The impermeable layer may act at one or a plurality of openings to plug fluid flow therethrough. For example, the screen can include an inner or an outer covering on its sidewall that covers a plurality of openings. Alternately or in addition, an impermeable layer can be applied to or incorporated in the filter cartridges. In one embodiment, impermeable layer 30 may be applied on or adjacent exterior and/or interior filter cartridge retainer plates 22*a*, 24*a* or can be incorporated into the filter cartridges, as for example by infiltration into filter media 20*a*. It may be useful to position the impermeable layer such that it is protected against direct contact or to facilitate manufacture. In one embodiment, the impermeable layer can be protected within components of the filter cartridge, as shown. The impermeable layer may serve to cover/block/plug the openings and the filter cartridge in order to prevent the flow of fluid therethrough and/or to prevent access of solids to the filter media, until the impermeable layers are selectively opened.

The impermeable layer may comprise various materials, such as aluminum foil, glass, wax, cellulose, polymers, and so on. The impermeable layer may be opened to permit fluid flow, as by removal or breaking, once the wellbore screen is in position down hole. The method of opening can vary based on the material of the impermeable layer, and may include pressure bursting, impact destruction, and/or removal by solubilization, melting, etc. as by acid, caustic or solvent circulation, temperature sensitive degradation, and so on.

In one application, a wellbore screen including impermeable layers relative to its openings, may be useful to resist plugging of the openings, which can result for example from the rigors of running in. In another application, the impermeable layers are used to selectively allow flow along or from a certain section of the wellbore, while flow is blocked through other openings. In yet another application, a wellbore screen including impermeable layers relative to its openings, may be useful to permit drilling of the screen into the hole, as by liner or casing drilling. In such an application, the impermeable layers can be selected to hold the pressures encountered during drilling, for example, pressures of a couple of hundred psi. In such an embodiment, the impermeable layers will be present to plug the openings at least when the wellbore screen is being run down hole so that the wellbore screen may be drilled directly into the hole. Once the screen is drilled into position, the impermeable layers may be opened, as by bursting with application of fluid pressure above that which the layers can hold.

Depending on the application, it may be useful to seal all of the openings of a wellbore screen or it may be useful to block only certain of the openings, while others are left open. In another embodiment, it may be useful to use selected materials to form the impermeable layers on a first group of openings while another impermeable layer material is used over the openings of a second group so that some openings within a liner, for example those of the first group, can be opened while others, for example the openings of the second group, remain closed until it is desired to remove or break open that impermeable material.

One or more impermeable layers can be used, as desired. The layers may be positioned to provide protection to certain filter cartridge components. For example, where media plugging is a concern the impermeable layer can be positioned to protect against plugging such as by positioning the impermeable layer adjacent exterior retainer plate 22*a* to protect against plugging by external flows or materials. Alternately or in addition, an impermeable layer may be provided between inner retainer plate and the filter media to prevent plugging by flow from inside to outside.

In the illustrated embodiment of FIG. 3, impermeable layer 30 is positioned between exterior retainer plate 22*a* and filter media 20*a* to prevent plugging of the filter media by scraping along the wellbore during run in and by external fluid flows.

It is noted that FIG. 3 also illustrates an embodiment wherein plastic deformation has been used to form a material extension 32 from the base pipe that overlies the outer surface of the filter cartridge to secure the cartridge in opening 14*a*. It is also noted that a filter media 20*a* of multiple layered, woven materials is illustrated.

Figure 4:
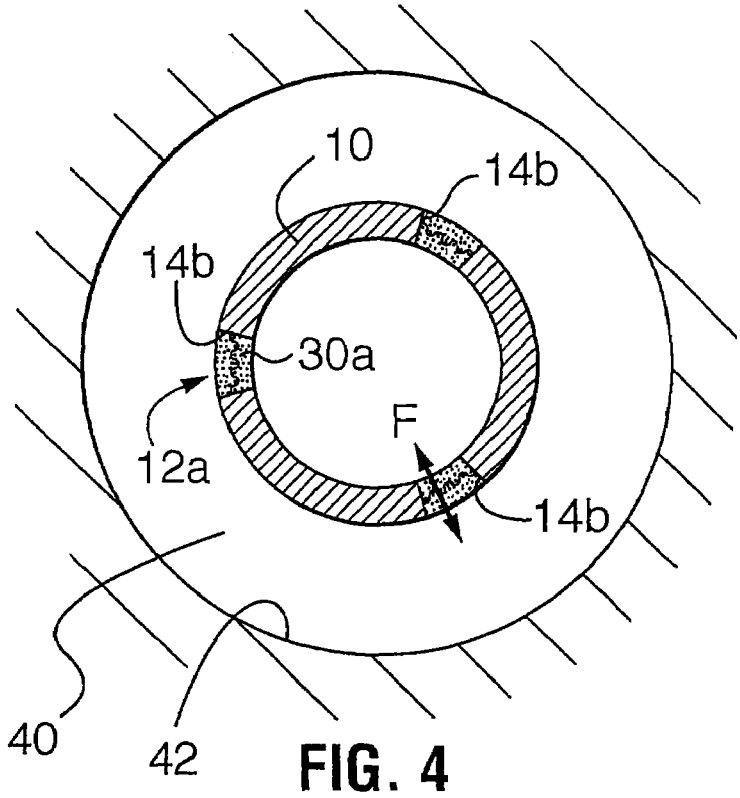
FIG. 4 is an axial section through another wellbore screen.

A wellbore screen, as illustrated in FIG. 4, that is selectively closeable may also be useful where it would be beneficial to run in and/or operate the wellbore screen having open filter cartridges 12*a*, which are later intended to be closed. Such closing may be provided by an impermeable layer associated with the openings of the base pipe 10, the layer being selected to close by a trigger such as for example a chemical such as water or a catalyst, etc. pumped into the well to contact the layer, temperature changes, etc. In one embodiment, an impermeable layer 30*a* may be provided by a chemical agent in a filter cartridge 12*a*. The chemical agent impermeable layer, when it has not yet been triggered, permits fluid flow F through the openings 14*b* in which the filter cartridges and the layer are mounted. However, the impermeable layer of chemical agent acts, when triggered by contact with water, to swell and plug its filter cartridge and opening, for example, by plugging the pores of the filter media.

Figure 5:
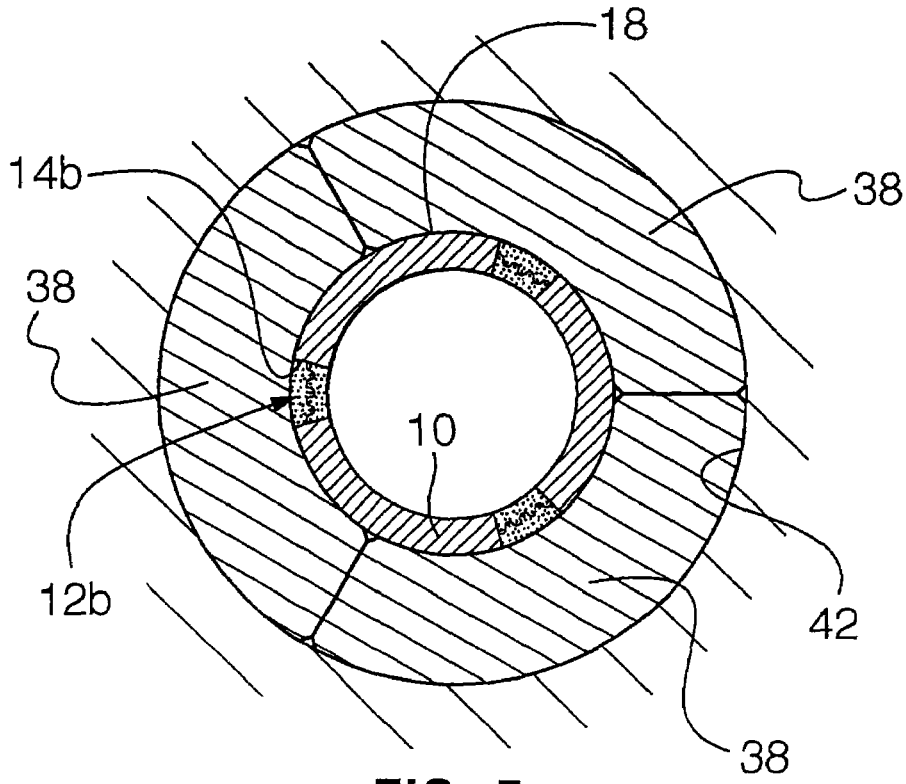
FIG. 5 is an axial section through another wellbore screen.

In another embodiment illustrated in FIG. 5, an impermeable layer associated with the openings, may be selected such that it is normally open but, when triggered, it is capable of swelling to generate impermeable layer material 38 at least beyond the outer surface 18 of the wellbore screen and possibly in the inner bore of the base pipe 10, as well. Sufficient impermeable layer material 38 may be generated during swelling such that the annulus 40 between the screen and the borehole wall 42 may be plugged, thereby preventing flow along the annulus. One application where this would be beneficial is in water shut off operations in uncemented horizontal or vertical wells. In such an application, a liner may be used with wellbore screens installed therein and at intervals along the liner and screens position wellbore screen joints with water shut off cartridges. When triggered the impermeable layer material in the cartridges may swell out of the openings 14*b* to plug the annulus. The plug may prevent the production of water or fluids therepast.

Figure 6:
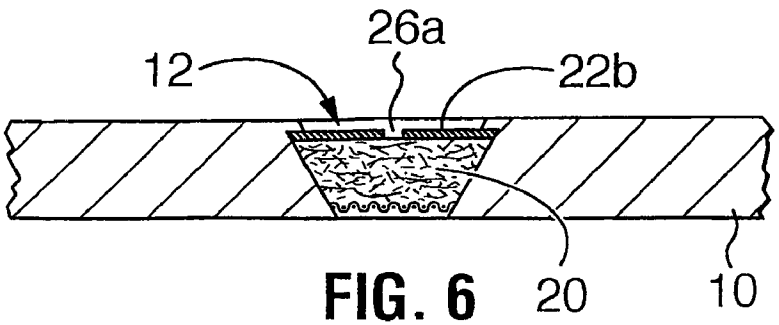
FIG. 6 is a section through another wellbore screen.

With reference to FIG. 6 another embodiment is shown wherein filter cartridge 12*b* is formed to act as a nozzle, as by providing a nozzle component such as for example aperture 26*a* in a retainer plate 22*b*, and includes filter media 20*b*. As such, filter cartridge 12*b* can act to provide sand control and can also have the necessary characteristics to act as a nozzle to vaporize, atomize or jet fluid flow to select injection characteristics. Thus, any fluids introduced through the screen can be shaped or treated to improve contact with the reservoir. In another embodiment, the opening may be formed to act as a nozzle and the filter cartridge may be positioned therein.

The wellbore screen configured according to any or a combination of the various embodiments noted above can be incorporated in a wellbore liner or casing or a string of screens and installed in a wellbore. As such the screen may include one or more connectable (i.e. threaded) ends formed as pins 34, as shown, or boxes, a closed end, or other configurations, as desired.

It is to be understood that even though certain characteristics of the present invention have been set forth in the foregoing description, the description is illustrative only, and changes may be made within the principles of the invention.

What is claimed is:

1. A method for wellbore treatment comprising:

providing a wellbore screen comprising: a base pipe including a wall, an inner bore surface and an outer surface, at least one opening formed through the base pipe wall, an impermeable layer in the at least one opening and a filter cartridge mounted in the at least one opening;

positioning the wellbore screen in a wellbore;

opening the impermeable layer; and introducing wellbore treatment fluids through the wellbore screen such that it flows out into the wellbore through the at least one opening.

2. The method of claim 1 wherein introducing wellbore treatment fluids includes at least one of vaporizing, atomizing or jetting the wellbore treatment fluids into the wellbore.

3. The method of claim 1 wherein introducing wellbore treatment fluids includes introducing at least one of steam or stimulation fluids into the wellbore.

4. The method of claim 1 further comprising closing the at least one opening after introducing wellbore treatment fluids.

5. A method for wellbore treatment comprising:

providing a wellbore screen comprising: a base pipe including a wall, an inner bore surface and an outer surface, at least one opening formed through the base pipe wall, an impermeable layer disposed in the opening and a filter cartridge mounted in the at least one opening;

positioning the wellbore screen in a wellbore;

introducing wellbore treatment fluids through the wellbore screen such that it flows out into the wellbore through the at least one opening; and closing the at least one opening after introducing wellbore treatment fluids.

6. The method of claim 5 wherein the wellbore screen includes the impermeable layer in the at least one opening and the method further comprises opening the impermeable layer prior to introducing wellbore treatment fluids.

7. The method of claim 5 wherein introducing wellbore treatment fluids includes at least one of vaporizing, atomizing or jetting the wellbore treatment fluids into the wellbore.

8. The method of claim 5 wherein introducing wellbore treatment fluids includes introducing at least one of steam or stimulation fluids into the wellbore.

* * * * *